US012279663B2

(12) United States Patent
Erickson

(10) Patent No.: US 12,279,663 B2
(45) Date of Patent: Apr. 22, 2025

(54) KIT FOR REMOVABLY ATTACHING EYEGLASSES TO HEADWEAR

(71) Applicant: Jett Erickson, Hailey, ID (US)

(72) Inventor: Jett Erickson, Hailey, ID (US)

( * ) Notice: Subject to any disclaimer, the term of this patent is extended or adjusted under 35 U.S.C. 154(b) by 109 days.

(21) Appl. No.: 18/135,704

(22) Filed: Apr. 17, 2023

(65) Prior Publication Data

US 2024/0341389 A1 Oct. 17, 2024

(51) Int. Cl.
*A42B 1/247* (2021.01)

(52) U.S. Cl.
CPC ..... *A42B 1/247* (2013.01)

(58) Field of Classification Search
CPC ..... A42B 1/247; G02C 3/02; G02C 3/006
See application file for complete search history.

(56) References Cited

U.S. PATENT DOCUMENTS

| | | | | |
|---|---|---|---|---|
| 6,481,059 | B2 | 11/2002 | Morris | |
| 6,637,074 | B1 | 10/2003 | Morris | |
| 6,668,426 | B1 | 12/2003 | Morris | |
| 6,959,989 | B2 | 11/2005 | Holm | |
| 7,240,374 | B2 | 7/2007 | Fang | |
| 7,255,436 | B2 | 8/2007 | Tracy | |
| 7,866,813 | B2 | 1/2011 | Anhalt | |
| 7,904,970 | B2 | 3/2011 | Thomas | |
| 8,381,359 | B1 | 2/2013 | McArdle | |
| 8,573,773 | B1 | 11/2013 | Acosta | |
| 8,696,112 | B1 | 4/2014 | Vaught | |
| 9,155,347 | B2 * | 10/2015 | Van Waes | A42B 3/04 |
| 9,565,884 | B2 * | 2/2017 | Grame | A45F 5/02 |
| 10,394,048 | B2 | 8/2019 | Walker | |
| 10,517,345 | B2 | 12/2019 | Luo | |
| 11,067,827 | B2 | 7/2021 | Masters et al. | |
| 11,275,257 | B2 | 3/2022 | Lowe | |
| 2003/0024033 | A1 | 2/2003 | Viggiano | |
| 2006/0152671 | A1 | 7/2006 | Risso et al. | |
| 2007/0229759 | A1 | 10/2007 | Jones | |
| 2012/0272483 | A1 | 11/2012 | Moore | |
| 2018/0292675 | A1 | 10/2018 | Sandoval | |

(Continued)

OTHER PUBLICATIONS

2pk Xcap By Kombi—The Baseball Hat That Holds Sunglasses retrieved from https://www.pinterest.com/pin/182888434853750117/ on Mar. 30, 2022.

(Continued)

*Primary Examiner* — Katherine M Moran
(74) *Attorney, Agent, or Firm* — Burdick Patents, P.A.; Sean D. Burdick; Colin L. Honan

(57) ABSTRACT

A kit for securing eyeglasses to headwear includes a hat attachment assembly having an engaging plate, a retaining plate, and a first magnetic material. The retaining plate defines a throughhole, and a prong extending from the engaging plate engages the retaining plate by insertion through the headwear and throughhole. A temple attachment member has a flexible hollow sleeve, a recessed surface on one side of the sleeve, and second magnetic material installed in the recessed surface. The flexible hollow sleeve can slidably engage a temple of the eyeglasses, so that the eyeglasses when placed on the headwear equipped with the attachment assembly are held thereto by attraction of the magnetic materials. The first and second magnetic materials may be interchangeably installed in the engaging plate and the flexible sleeve.

18 Claims, 12 Drawing Sheets

(56) References Cited

U.S. PATENT DOCUMENTS

| | | | |
|---|---|---|---|
| 2020/0008506 | A1 | 1/2020 | Hilles et al. |
| 2021/0000208 | A1 | 1/2021 | Whedbee |
| 2022/0057649 | A1 | 2/2022 | Zabel |

OTHER PUBLICATIONS

EyzGear Patented Clip on Glasses Holder—Visor and Hat Clip on Retainer—Black—1 Pack, retrieved from https://www.amazon.com/EyzGear-Patented-Clip-Glasses-Holder/dp/B076L2HN9R on Mar. 30, 2022.

Full Brim Vented Hard Hat with BOLT™ Accessories—Type 1 Class C, retrieved from https://www.milwaukeetool.com/Products-Repository/North-America/Safety/Personal-Protection-Equipment/Hard-Hats/Full-Brim-Hard-Hat on Mar. 30, 2022.

LidsLash Orig. 2-Pack, retrieved from https://lidslash.com/products/lidslash-orig-2-pack?variant=31506297389104 on Mar. 30, 2022.

Mossy Oak Opti Grab Sunglasses Holder, retrieved from https://t-capsusa.com/products/mossy-oak-opti-grab-sunglasses-holder1 on Mar. 30, 2022.

Popvcly Outdoor Polarized Fish Glasses Hat Visors Sport Clips Caps Clip on Sunglasses for Biking Hiking Golf Eyewear UV400, retrieved from https://www.walmart.com/ip/Popvcly-Outdoor-Polarized-Fish-Glasses-Hat-Visors-Sport-Clips-Caps-Clip-On-Sunglasses-for-Biking-Hiking-Golf-Eyewear-UV400/652431429?from=/search on Mar. 30, 2022.

* cited by examiner

20

200

KIT FOR REMOVABLY ATTACHING EYEGLASSES TO HEADWEAR

BACKGROUND OF THE INVENTION

Field of the Invention

The present invention relates generally to accessories for sunglasses and hats, and more particularly to a kit for attaching sunglasses to a hat.

Description of the Related Art

Common accessories for many people include hats and eyeglasses, such as sunglasses. It is not unusual for people to wear a hat and eyeglasses at the same time. Many people who wear baseball-style caps and sunglasses habitually place the sunglasses temporarily onto the visor or bill of the hat when they are not needed for shielding the eyes. For example, a golfer may need to remove his sunglasses briefly, for sharper eyesight when attempting a shot from a shaded area or when looking for a golf ball lost in the rough. Because both hands are needed to grasp a golf club and make the shot, the golfer may place the sunglasses onto the bill of his cap, so that the lenses rest against the front panel of the cap, and so that the temples lie along and clamp against the side panels of the cap to keep the sunglasses in place. Also, an athlete playing baseball may similarly temporarily remove his sunglasses to his cap when manning the outfield as clouds intermittently cast shadows. There are in fact many scenarios, athletic or otherwise, in which someone wearing a hat and eyeglasses may need to remove the eyeglasses and temporarily perch them onto their hat.

A problem that commonly occurs when a person has placed their glasses onto their hat is that the glasses, not being very firmly secured, fall off accidentally and become damaged or lost. Aside from the annoyance of losing sunglasses on a sunny day, the replacement cost can be substantial, depending on the make and model. Today the cost of many designer sunglasses exceeds two hundred dollars, and the replacement cost of prescription eyewear can be even greater.

There have been many attempts to solve this problem, as found in the records of the U.S. Patent Office. A recent solution proposed by Masters et al. in U.S. Pat. No. 11,067,827 affixes magnets to the temples of a pair of eyeglasses, and also affixes magnetic material to varying locations along the curvature of a circular hatband insert. The invention also requires a specialized retaining strap that attaches to the temples of the eyeglasses to provide a secondary means for retaining the eyeglasses, e.g. around the user's neck. This solution, however, is overly complicated and requires installation of multiple component pieces that may be unappealing to the user. Further, the hatband insert cannot be universally installed within all types of headwear, which limits the solution to only those hats having an integral hatband capable of receiving the hatband insert.

Another recent solution has been proposed by Lowe in U.S. Pat. No. 11,275,257 in which glasses are retractably attached to a hat via a tensioned retaining mechanism, e.g., a retractable tether mechanism. The invention also requires specialized glasses equipped with adjustable lenses wherein the lens angle is adjustable via a ratchet mechanism integral with the temple area of the glasses. This solution can be unsightly to a user who does not wish to have a tether attached between their glasses and hat. Further, the invention cannot be universally applied to existing glasses and hats as it requires a specialized frame to provide for the adjustability of the lens angle.

A third solution has been proposed by Luo in U.S. Pat. No. 10,517,345 wherein magnets on the arms of a pair of glasses cooperate with magnets attached to the sides of the hat. The invention requires a specialized hat design whereby a cavity is formed in the hat to accommodate magnets to at least partially fit each magnet on the glasses. This specialized design of the cooperating magnets can result in an increase to the manufacturing cost. Further, the magnetic cavity on the outside of the hat can be undesirable for some users.

What is needed is a simple and economic solution to firmly secure eyeglasses to a hat when the eyeglasses are not in use.

SUMMARY OF THE INVENTION

The foregoing problems are overcome by a kit designed to be universally deployed with any type of glasses and any type of headwear. The kit requires minimal installation with little to no modification of the glasses and headwear it is deployed on.

In a first embodiment, the kit has at least one hat attachment assembly that is designed to magnetically connect with a temple attachment member. In preferred embodiments, the kit has two hat attachment assemblies and two temple attachment members.

The hat attachment assembly is designed with two plates that will sandwich the side panel of the headwear between them. The engaging plate attaches to the outer surface of the side panel and has at least one bendable prong that can extend through the side panel to an inside surface. The prong is bendable about the perpendicular axis of the backside of the engaging plate. Positioned on the inside surface of the side panel is a retaining plate designed to receive the prong and sandwich the side panel between the two plates. In some embodiments, the engaging plate is made from a ferromagnetic material to magnetically connect with the temple attachment member. In alternative embodiments, the engaging plate can have a magnet embedded in the outer side to magnetically connect with the temple attachment member. Alternatively, the outer side of the engaging plate may be coated with a magnetic material.

The temple attachment member is designed as a hollow sleeve that can be slidably engaged with the temple of the glasses it is deployed on. The hollow sleeve has a recessed surface defined in a first side and substantially filled with a magnetic material. The magnetic material magnetically connects the temple attachment member to the hat attachment assembly. In preferred embodiments, the hollow sleeve is designed as an open-ended flexible sleeve. The open-ended flexible sleeve can be made from a synthetic material, such as rubber, that generates sufficient frictional forces with the temple of the glasses to maintain its relative position thereon. In such embodiments, a magnetic disk fills the recessed surface and is designed to magnetically connect to the engaging plate of the hat attachment assembly.

In alternate embodiments of the temple attachment member, the recessed surface is defined in a block portion and has a magnetic disk that is adhesively secured therein. The recessed surface has a depth corresponding to the thickness of the magnetic disk to create a smooth surface. In such embodiments, a flexible member extends from a first side of the block to the opposite side to form the hollow sleeve. The flexible member is preferably made from a synthetic material, such as rubber, while the block is made from a hard material, such as hard plastic. In some embodiments, the flexible member may form an open-ended hollow sleeve which the temple of the glasses can completely pass through, allowing a user to position the temple attachment member at substantially any position along the length of the temple. In alternate embodiments, the flexible member is closed at one end such that only a length of the temple tip slides therein and the temple attachment member is positioned substantially around the length of the temple that would sit on a user's ear.

In one embodiment, the recessed surface of the temple attachment member can have an embedded ferromagnetic metal or coated with a magnetic powder which will magnetically connect with a removable magnetic disk and the front surface of the engaging plate is also coated with a ferromagnetic material. Due to the polar orientation of the magnetic disk, the disk magnetically connects the temple attachment member to the hat attachment assembly. The disk can be movable between the two components such that the disk can be maintained in the recessed surface of the temple attachment member or on the engaging plate of the hat attachment assembly. This also provides a user with the option to easily replace a magnetic disk that may be lost without having to replace the entirety of the kit, making the kit more user friendly.

In some embodiments of the hat attachment assembly, the retaining plate has at least one slit to receive a prong that is bendable about an axis perpendicular with the backside. In preferred embodiments, the engaging plate has two prongs extending from the backside and the retaining plate has two slits which are sandwiched between an aperture. The aperture is designed to retain the tip end of a first prong when bent inwards and thereafter the second prong is bent inwards on top of the first prong. In alternate embodiments, the prong can be a pointed pin and the retaining plate has a corresponding aperture with means to engage the pin. Preferably, the engagement means is an internal locking mechanism contained within the retaining plate. The retaining plate may have a fin on the backside to house the internal locking mechanism or may be designed with a sufficient thickness to completely contain the locking mechanism therein.

In preferred deployments of the disclosed kit, two hat attachment assemblies and two temple attachment members are used. The engaging plate of each assembly is positioned on substantially opposite side panels of the hat and the prong(s) is pushed therethrough from an outside surface of the hat to an inside surface. With engaging plates in position, the retaining plate is then positioned to receive the prong extending through the hat. The prong is bent about the perpendicular axis of the backside until the prong is substantially parallel with the backside and sufficiently engaged with the retaining plate. The temple attachment member is connected to the temple of the glasses by sliding the temple of the glasses into the hollow sleeve. Depending on the embodiment, the hollow sleeve may be open-ended allowing a user to position the temple attachment member substantially anywhere along the length of the temple or it may be closed at one end such that the end of the temple cannot be extended all the way through. The temple attachment member is positioned such that the recessed surface filled with magnetic material is facing inwards. In such position, the temple attachment member on the glasses can magnetically connect to the hat attachment assembly on the hat. Now, a user can safely remove their glasses from their face and place them on the brim of their hat by positioning the temple attachment members in a location corresponding to the hat attachment assemblies on their hat to magnetically secure the glasses on the hat.

In some embodiments of the kit, the temple attachment member is configured as a ring with magnetic material secured in a recessed portion defined within the ring. The ring can include a thickened body portion with the recessed portion being defined therein. A cup can also be secured within the recessed portion, the cup securely engaging the magnetic material to hold it within the temple attachment member. In some embodiments, the thickened body portion has a notch defined about an inner perimeter which corresponds to a ridge defined about the outer perimeter of the cup. The ridge engages with the notch to secure the cup in the thickened body portion of the ring.

The engaging plate of the hat attachment assembly can have a threaded protrusion extending from the inner surface thereof. The retaining plate has a corresponding aperture with female threads for receiving the threaded protrusion. In some embodiments, the retaining plate also has a shoulder formed about the aperture to provide added depth to the aperture. When the female threads of the aperture are fully engaged with the threaded protrusion, a gap is formed between the inner surface of the engaging plate and the top surface of the shoulder. The gap can reduce the appearance of the panel of the hat being scrunched between the engaging plate and the retaining plate. The retaining plate can also include a plurality of gripping ridges formed about an outer perimeter thereof. The gripping ridges can be useful when installing the hat attachment assembly through the panel of the hat as they provide a user with a gripping surface for engaging the threads.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE DRAWINGS

The following disclosure presents exemplary embodiments for a kit for removably securing a pair of eyeglasses to headwear, such as a ballcap. Throughout the disclosure, the "headwear" will be interchangeably referred to as a "hat" or "ballcap" with the understanding that the invention is in no means limited by the type of headwear. It should be understood that a kit according to the invention can be universally applied to all types of headwear, including hats, ballcaps, and even hardhats, with minimal modification of the headwear to accommodate the kit. Further, the kit can be used with most any type of eyeglasses, particularly with eyeglasses that provide one or two temples designed to rest above a wearer's ear. Such eyeglasses include but are not limited to, sunglasses, safety glasses, reading glasses, and corrective prescription glasses. Throughout the following description the glasses may be referred to as glasses or sunglasses with the understanding the disclosed invention is not limited by the type of glasses described herein.

A kit according to the present invention provides for the easy and secure attachment of a pair of sunglasses to a hat. The inventive kit may be easily installed by a user manually, and in most cases, can be applied without having to modify the hat. Since the kit is not limited to a specific type of headwear, in some instances a user may be required to slightly modify the headwear to accommodate the inventive kit, as will be more fully explained below.

Figure 1:
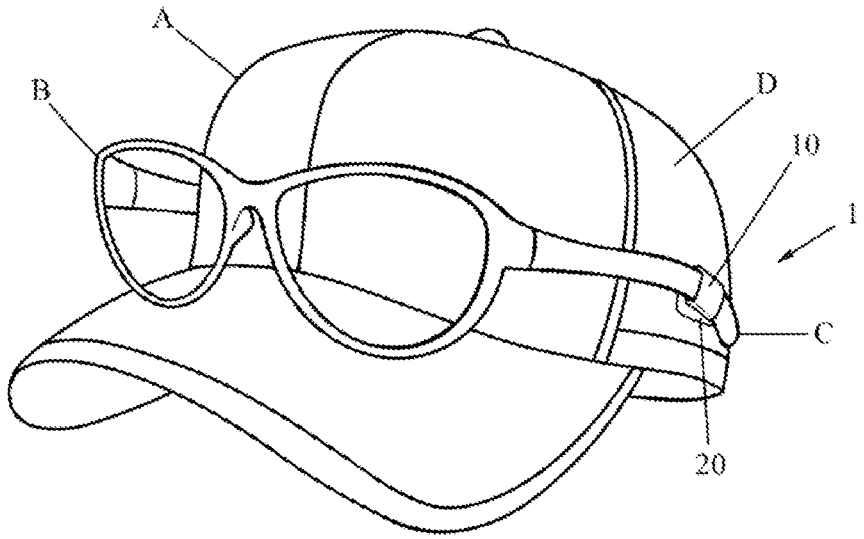
FIG. 1 is a perspective view of a pair of sunglasses removably attached to a ballcap using a kit according to the present invention.

FIG. 1 is a perspective view of a ballcap A to which a pair of sunglasses B is removably attached using a kit 1 according a first embodiment of the present invention. The kit 1 employs a temple attachment member 10 removably engaged on a temple C of the sunglasses B. The kit 1 also has a hat attachment assembly 20 removably attached to a side panel D of the ballcap A. The temple attachment member 10 and the hat attachment assembly 20 work together to allow a user to removably attach sunglasses or other eyewear to a hat. The temple attachment member 10 may be positioned anywhere along the length of the temple C, but preferably at a position where the temple attachment member 10 can engage the hat attachment assembly 20 when the sunglasses are perched on the hat.

Figure 2:
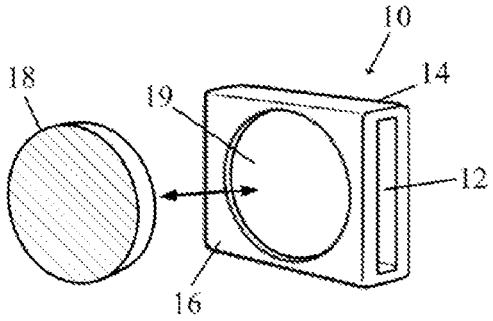
FIG. 2 is a rear perspective view of one embodiment of a temple attachment member of a kit according to the invention.

FIG. 2 is a rear perspective view of a first embodiment of the temple attachment member 10. The temple attachment member 10 has an aperture 12 configured to removably receive the temple C of the sunglasses. The aperture 12 is defined between an outer member 14 integrally connected to an opposing inner member 16. In some embodiments, the inner member 16 is configured as a block such that the temple attachment member 10 cannot freely rotate about the temple C of the sunglasses. Preferably, the outer member 14 is made from a flexible material such that it can be stretched over the temple when being slid thereon. In another embodiment, the inner member 16 is also flexible, and may be made from the same materials as the outer member 14. In any of these embodiment, the aperture 12 is configured as the hollow portion of a sleeve for removable attachment to the temple C of the sunglasses by sliding the temple into and out of the aperture 12. Preferably, the aperture 12 is configured to allow a user to slide the sunglass attachment member over the temple of the sunglasses with minimal resistance. Friction between the temple and the temple attachment member 10 maintains the relative positioning of the temple attachment member on the temple C. In a preferred embodiment, the outer member 14 is composed of a synthetic silicone rubber.

Magnetic material 18 is embedded in the surface of the inner member 16. The magnetic material 18 must be sufficiently strong to magnetically hold the sunglasses in place on the ballcap when the ballcap is subject to forces associated with normal usage. A recessed surface 19 is defined in the inner member 16 to receive the magnetic material 18. The recessed surface 19 is preferably of a depth such that the inner member 16 is smooth and the magnetic material 18 does not protrude any significant distance outwards therefrom. In some embodiments, an adhesive may be used to secure the magnetic material 18 in the recessed surface 19. Alternatively, the magnetic material 18 may be completely molded over in the recessed surface 19 when the temple attachment member is manufactured according to conventional injection molding techniques.

In other embodiments, the temple attachment member 10 may be designed in other shapes, such as a ring or triangle. The outer member 14 can be of any design or shape so long as it integrally attaches to the inner member 16 to create the aperture 12 for receiving the temple of the glasses.

Figure 3:
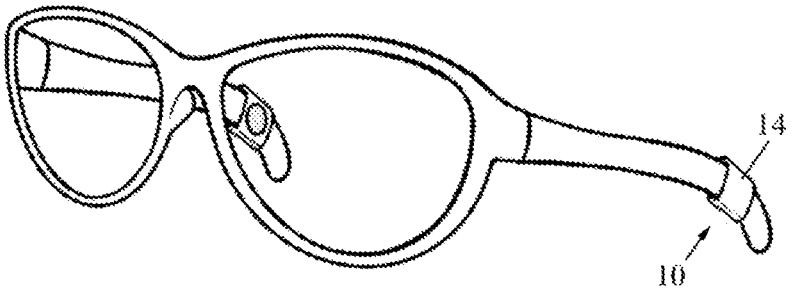
FIG. 3 is a perspective view of a pair of sunglasses equipped with temple attachment members according to one embodiment of the invention.

FIG. 3 is a perspective view of two of the first embodiment of the temple attachment member 10 removably attached to the arms C of the sunglasses. In a preferred embodiment of the inventive kit, there is two temple attachment members 10 to removably engage with each of the temples of the sunglasses.

In alternate embodiments, the temple attachment member 10 may be completely molded from a flexible synthetic material with the magnetic material 18 embedded therein. In this embodiment, the material making up the temple attachment member 10 needs to be sufficiently flexible such that the aperture 12 can be stretched to receive the arm of the sunglasses while maintaining a tight grip thereon once properly placed. In these embodiments, the magnetic material 18 can be a solid disk that the temple attachment member 10 is molded over. The solid disk of magnetic material 18 aids in preventing rotation of the temple attachment member 10 around the temple of the sunglasses because it will not easily rotate about the differing dimensions of the temple of the sunglasses due to its rigidity. Alternatively, a magnetic powder may be mixed with the synthetic material during the molding process such that the entirety of the temple attachment member 10 has magnetic properties. In such embodiments, the relative orientation of the temple attachment member 10 becomes largely irrelevant as all sides will posses magnetic capabilities.

Figure 4:
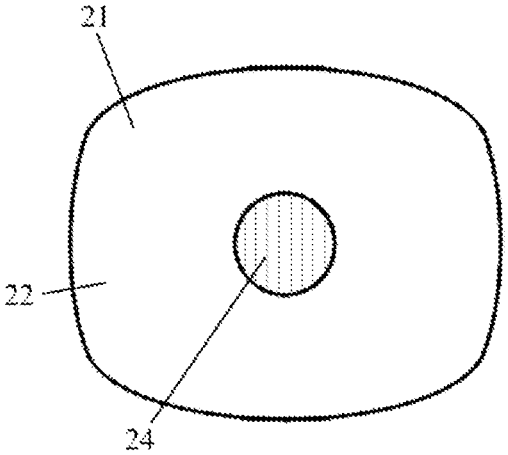
FIG. 4 is a frontal view of one embodiment according to the invention of an outer part of a hat attachment assembly.
Figure 5:
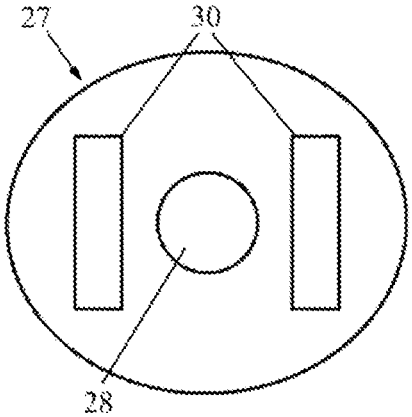
FIG. 5 is a frontal view of one embodiment according to the invention of an inner part of a hat attachment assembly.
Figure 6:
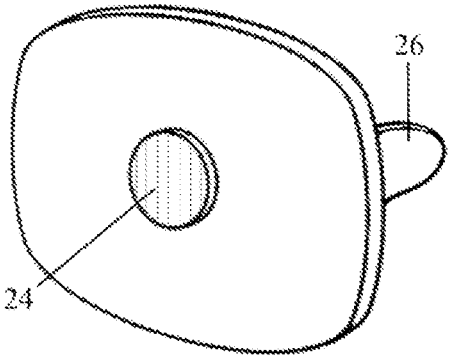
FIG. 6 is a frontal perspective view of the outer part illustrated in FIG. 4.

FIGS. 4-7 are various views of a first embodiment of the hat attachment assembly 20. The hat attachment assembly 20 employs two component pieces working together to sandwich a side panel D of the hat therebetween. FIG. 4 is a front view of an embodiment of an engaging plate 21, which is one of the two component pieces of the hat attachment assembly 20. FIG. 5 is a front view of an embodiment of a retaining plate 27, which is the second component piece of the hat attachment assembly 20. Together, the engaging plate 21 and retaining plate 27 are configured to be removably attached together through the side panel or other portion of a hat.

The engaging plate 21 has a front side 22 and an opposite backside 32. As shown in the perspective view of FIG. 6, the backside 32 of the engaging plate has at least one prong member 26. The front side 22 is preferably a flat planar surface that will substantially conform to the side of the hat. In preferred embodiments, the engaging plate 21 is made from a ferromagnetic metal. In other embodiments, the engaging plate may be made from a cheaper metal with less magnetic capability. In such an embodiment, the engaging plate 21 has an embedded strong earth magnet 24 positioned substantially in the middle of the engaging plate 21. The magnet 24 of the engaging plate 21 cooperates with the magnetic material 18 of the temple attachment member 10 to magnetically secure the temple attachment member to the retaining plate. With the kit deployed on a hat and glasses, the magnets cooperate to magnetically secure the glasses to the hat, allowing the glasses to be safely stored on the brim of the hat by magnetically securing the temples of the glasses to the side panels of the hat. In some embodiments, the front side 22 may be substantially coated in a soft polymer material. The polymer coating may be used as a means for customizing the front side of the hat attachment assembly. For example, the front side may have a user's favorite team logo or even a company logo printed in the polymer coating.

Figure 7:
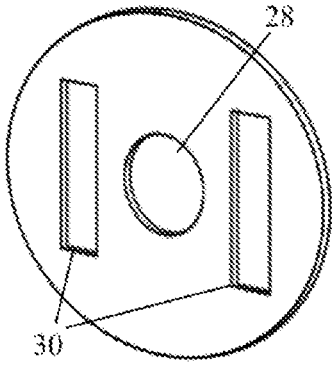
FIG. 7 is a frontal perspective view of the inner part illustrated in FIG. 5.

FIGS. 5 and 7 illustrate a first embodiment of the retaining plate 27. The retaining plate 27 is configured to be substantially flat with at least one slit 30. The slit 30 is configured to receive the prong 26 of the engaging plate. In preferred embodiments, the engaging plate has two prongs 26 that engage two opposing slits 30 in the retaining plate. Defined substantially in the middle of the retaining plate is an aperture 28. In preferred embodiments, the aperture 28 is formed substantially in the middle of the two opposing slits.

Figure 8:
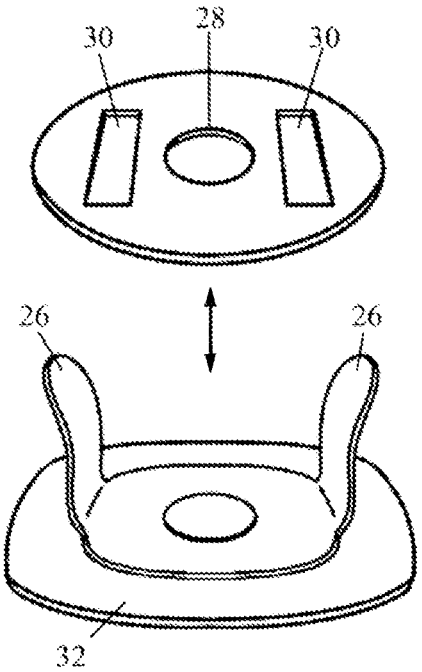
FIG. 8 is an exploded perspective view of a first embodiment of a hat attachment assembly according to the invention.
Figure 9:
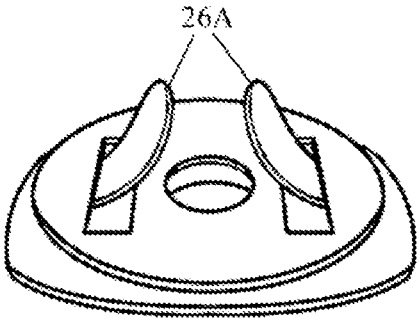
FIG. 9 is a perspective view of the first embodiment of the hat attachment assembly showing the outer part partially engaged to the inner part.
Figure 10:
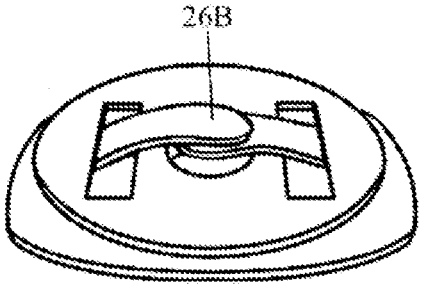
FIG. 10 is a perspective view of the first embodiment of the hat attachment assembly showing the outer part fully engaged to the inner part.

FIGS. 8-10 show the manner in which the engaging plate 21 is secured to the retaining plate 27 in one preferred embodiment. In the illustrated embodiment, the engaging plate has two opposing prongs 26 that are configured to be rigidly bendable. First, the two prongs 26 are bent so they are substantially perpendicular with the backside 32 of the engaging plate. The retaining plate is thereafter aligned with the engaging plate such that the two prongs 26 are received in the two opposing slits 30. The retaining plate is then slid down the prongs such that it is in close contact with the backside of the engaging plate. (Note, when the kit has been deployed on a hat, the fabric of the side panel of the hat will be sandwiched between the two plates of the hat attachment assembly.) Next, one prong is bent inward toward the opposing prong until a tip end of the prong is substantially in the aperture 28 of the retaining plate. Thereafter, the second prong is bent inwards such it is substantially on top of the first bent prong. The final engagement can be seen in FIG. 10.

Figure 11:
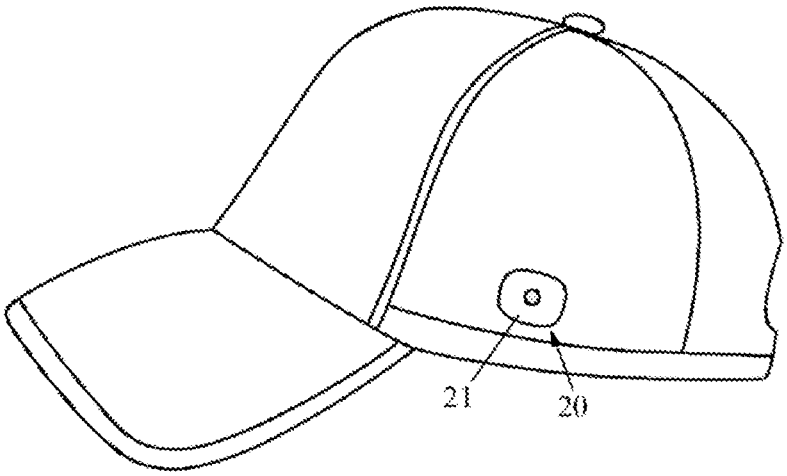
FIG. 11 is a side view of a ballcap having one embodiment of the hat attachment assembly removably attached thereto.
Figure 12:
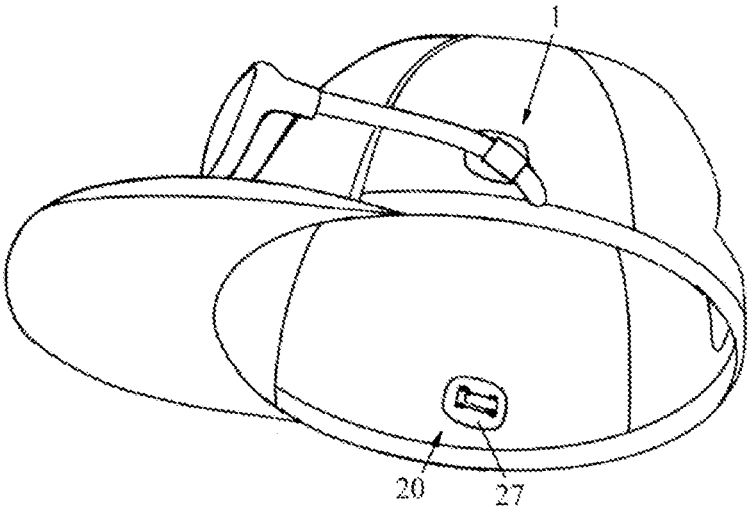
FIG. 12 is a lower perspective view of a pair of glasses removably attached to a ballcap using a kit according to the invention.

As can be seen in FIGS. 11-12, the hat attachment assembly is configured to be attached to a hat, preferably on a side panel thereof. FIG. 11 shows the retaining plate secured to an outer surface of the side panel of the hat. As can be seen in FIG. 12, the two opposing prongs 26 of the engaging plate have been inserted through the side panel of the hat and are now on the inner surface of the side panel of the hat. The two prongs have been received in the two opposing slits 30 of the retaining plate 27 and bent inward to secure the plates together. FIG. 12 also shows the temple attachment member 10 engaged on the temple of a pair of sunglasses. The embedded magnetic material 18 of the temple attachment member 10 magnetically secures the sunglasses to the hat through magnetic attraction with the engaging plate 21.

Figure 13:
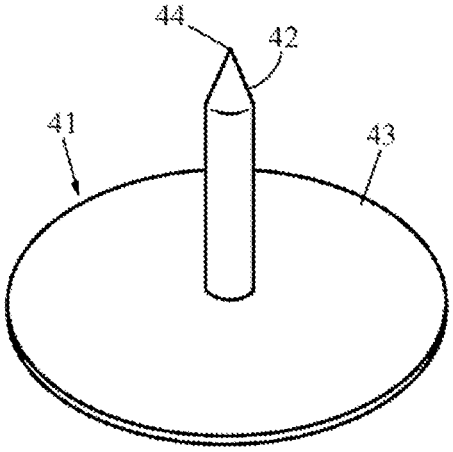
FIG. 13 is a perspective view of an outer part of a hat attachment assembly according to a second embodiment of the invention.
Figure 14:
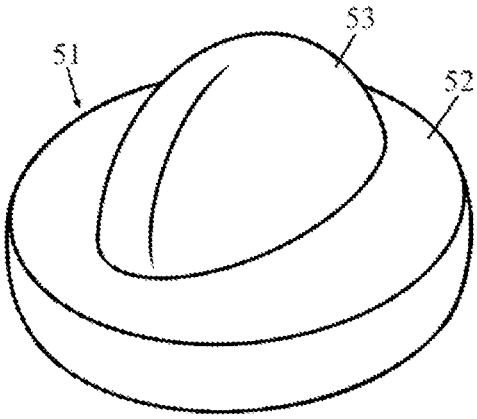
FIG. 14 is a perspective view of an inner part of a hat attachment assembly according to the second embodiment of the invention.
Figure 15:
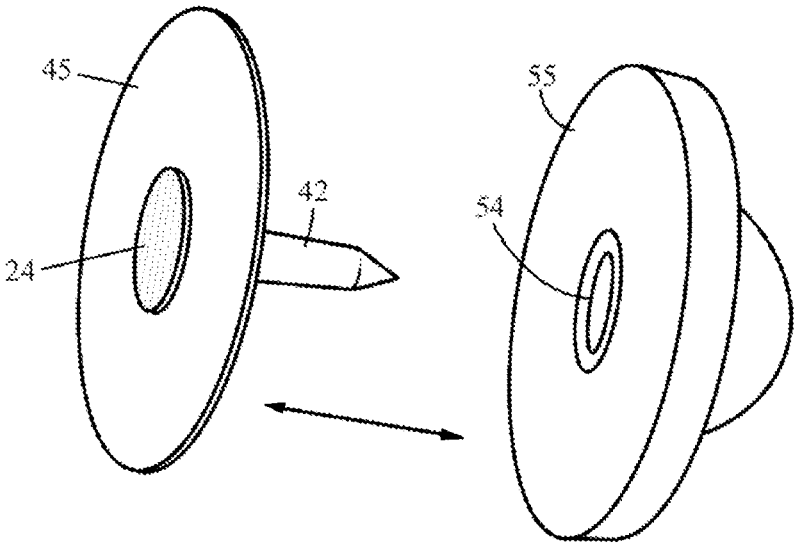
FIG. 15 is an exploded perspective view of the second embodiment of the hat attachment assembly.

FIGS. 13-14 illustrate a second embodiment of the hat attachment assembly 20. FIG. 13 is a perspective view of a second embodiment of an engaging plate 41. In this embodiment, the engaging plate 41 is configured with at least one pin 42. The pin 42 is preferably positioned substantially in the middle of the backside 43 of the engaging plate 41. In preferred embodiments, the pin 42 has a pointed tip 44. The pointed tip 44 of the pin 42 is configured to allow a user to push the pin through the material of a hat while minimizing damage to the hat. As can be seen in FIG. 15, the front side 45 of the engaging plate 41 has a magnet 24 embedded substantially in the middle thereof. In yet other alternative embodiments, the engaging plate 41 may be made from a ferromagnetic material thus alleviating the need for an embedded magnet.

FIG. 14 is a perspective view of a second embodiment of a retaining plate 51. The retaining plate 51 has a fin 53 extending from a backside 52. The fin 53 provides a gripping surface for a user when installing or removing the hat attachment assembly 20 from a hat and further provides a depth for which the pin 42 can be received in. A front side 55 of the retaining plate 51 has an aperture 54 configured for receiving the pin 42. The aperture 54 is defined substantially in the middle of the retaining plate 51 and extends into the depth of the fin 53. The aperture 54 has means for securely engaging the pin 42, such as an internal locking mechanism. In alternative embodiments, the retaining plate 51 may be designed such that the entirety of the retaining plate has a thickness corresponding to the length of the pin 42. In such embodiments, there is no longer a need for the fin 53 as the overall thickness of the retaining plate 51 is sufficient to enclose and receive the pin 42. The engagement means, such as an internal locking mechanism, will be contained within the thickness of the retaining plate. Further, by thickening the retaining plate, a user will have sufficient surface area to grasp the plate during installation or removal from a hat.

In use, the pin 42 is pushed through the material of a hat such that it extends from an outside surface to an inner surface of the hat. The retaining plate 51 is then placed on the inner surface of the hat such that the aperture 54 aligns with the pin 42. The retaining plate 51 is then engaged with the engaging plate 41 by pushing the two pieces together. The aperture 54 engages and secures the pin 42 therein. In this alternative embodiment, the front side 45 of the engaging plate may be coated with a polymer material to allow for customization of the piece by a user.

Figure 16:
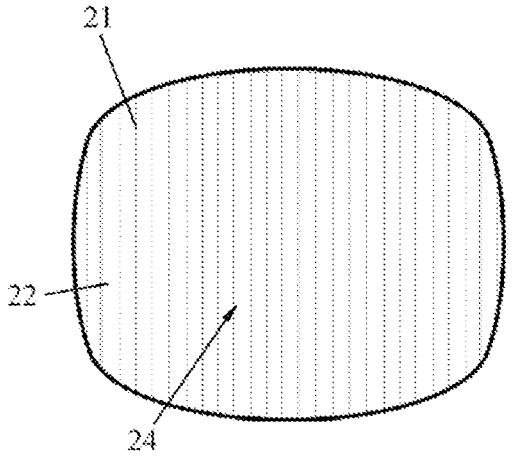
FIG. 16 is a frontal view of an outer part of a hat attachment assembly according to a third embodiment of the invention.
Figure 18:
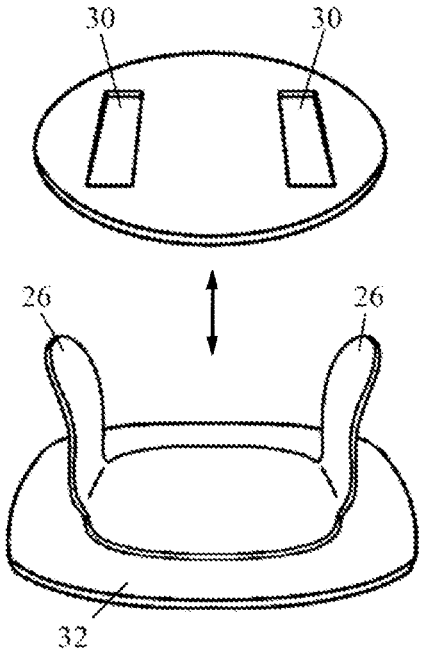
FIG. 18 is an exploded perspective view of the third embodiment of the hat attachment assembly.
Figure 17:
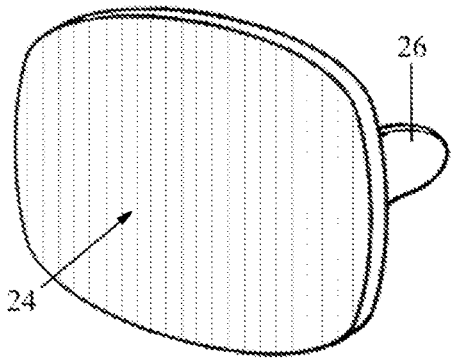
FIG. 17 is a frontal perspective view of the outer part illustrated in FIG. 16.

FIGS. 16-18 are various views of a third alternative embodiment of the hat attachment assembly. FIG. 16 is a front view of the engaging plate 21. The front surface 22 of the engaging plate 21 in this embodiment is configured to be substantially coated with a magnetic material 24 as opposed to the single embedded magnet or magnetic material illustrated in the prior embodiments detailed above. FIG. 17 is a frontal perspective view of the third embodiment of the engaging plate 21. The engaging plate 21 has at least one prong 26 extending from the backside, as described above. FIG. 18 is an exploded perspective view of the third embodiment of the hat attachment assembly 20. The hat attachment assembly 20 is similar to previous embodiments described except that now the retaining plate has only two slits 30 and does not have the aperture 28 positioned in the middle thereof. The engagement of this third embodiment of the hat attachment assembly is substantially similar to that previously described.

Figure 19:
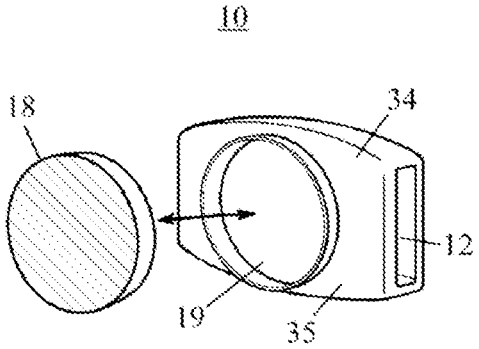
FIG. 19 is a rear perspective view of another embodiment of a temple attachment member of a kit according to the invention.

FIG. 19 is an exploded perspective view of an alternative embodiment of the temple attachment member 10. The temple attachment member 10 is configured as a flexible sleeve 34 having a hollow aperture 12 extending therethrough. The aperture 12 is configured to slidably receive the temple of the sunglasses. Preferably, the sleeve 34 is molded from a flexible synthetic material, such as rubber or soft plastic, that will generate friction when engaged to the temple of the sunglasses. The friction generated from the engagement is sufficient to maintain the relative positioning of the temple attachment member 10 on the temple of the sunglasses. The sleeve 34 has a recessed surface 19 defining a depth corresponding to a thickness of a magnetic disk 18. The depth of the recessed surface 19 is designed such that a surface 35 of the sleeve 34 is smooth when the magnetic disk 18 has been engaged therein. An adhesive may be used to secure the magnetic disk 18 in the recessed surface 19 of the sleeve 34. Alternatively, the magnetic disk 18 may be removably attached to the recessed surface 19. The magnetic disk 18 may engage the recessed surface 19 by friction fit or snap fit engagement.

In one embodiment of a kit 100, shown in FIGS. 16-19, the magnetic disk 18 is magnetically secured in the recessed surface 19 by embedding a small ferromagnetic metal therein or coating the inside of the recessed surface with such metal. Due to the polar orientation of the magnetic disk 18, a first side of the disk will magnetically secure the disk in the recessed surface 19 and the opposite side having an opposite polar orientation will magnetically connect to the front surface 22 of the engaging plate 21 coated with magnetic material 24. In this manner, the magnetic material 24 of the engaging plate and the magnetic disk 18 of the temple attachment member 10 have the same configuration, allowing the magnetic disk to be movable between the temple attachment member and the hat attachment assembly. Further, the kit 100 allows a user to easily and economically replace a lost magnetic disk 18 without having to replace the entirety of the kit.

Figure 20:
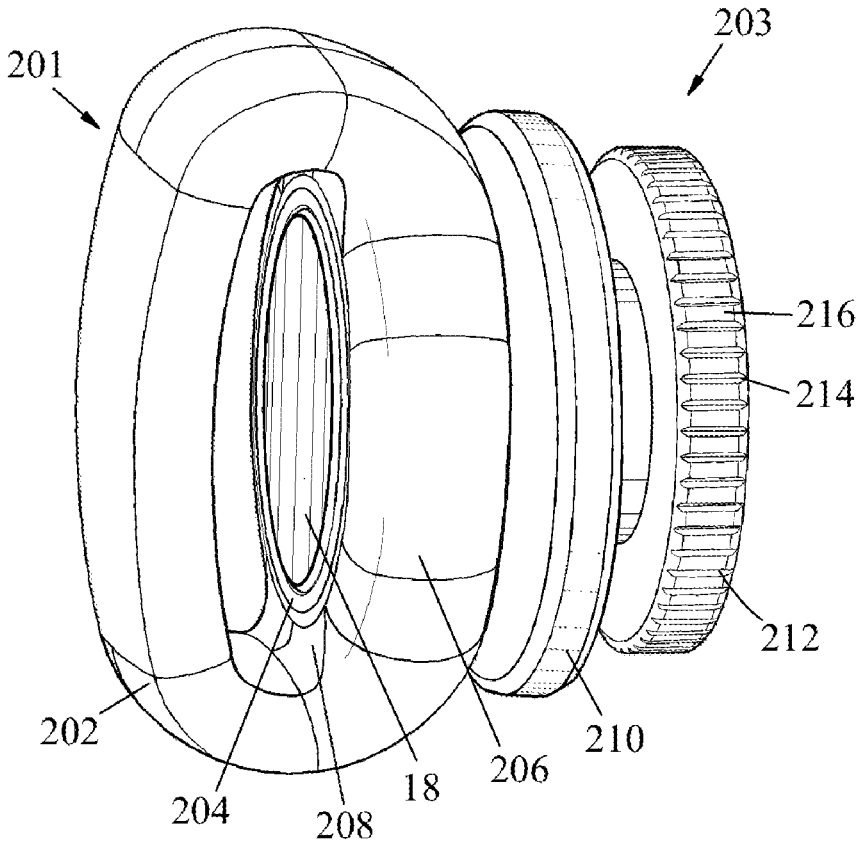
FIG. 20 is a side perspective view of an alternative embodiment of a kit according to the present invention.

FIG. 20 is a side perspective view of an alternate kit 200 according to the present invention. The kit 200 has a temple attachment member 201 configured as a flexible ring 202 with a cup 204 integrated into an inside surface of a thickened body 206 of the ring 202. The flexible ring 202 is integrally attached to the thickened body 206 to form an open aperture 12 therebetween.

The aperture 12 is configured to receive the temple C of the glasses. Preferably, the aperture 12 is configured to frictionally hold the temple attachment member 201 at a set position on the temple C of the glasses. The frictional engagement can be accomplished through a combination of the materials chosen for the flexible ring 202 and the relative size of the aperture 12 compared to the temple C of the glasses. The thickened body 206 also prevents rotational movement of the temple attachment member 201 about the axis of the temple C of the glasses.

The cup 204 is configured to receive and secure the magnetic disk 18 in the temple attachment member 201. The magnetic disk 18 must have a strong enough magnetic pull to magnetically attach to the hat attachment assembly 203 through the cup 204 and thickened body 206. Thus, a strong earth magnet is preferred. However, other magnetic materials may be sufficient so long as the magnetic force generated is strong enough to penetrate through the cup 204 and the thickened body 206 of the temple attachment member 201 to engage with the hat attachment assembly 203.

The kit 200 further includes a hat attachment assembly 203 configured as a threaded pin plate 210 engaged to a female receiving plate 212. The female receiving plate 212 can include a plurality of ridges 214 formed on an outer surface 216 of the plate. The ridges 214 provide a gripping surface for an operator to grasp when installing the hat attachment assembly 20 through a panel D of a hat A.

Figure 21:
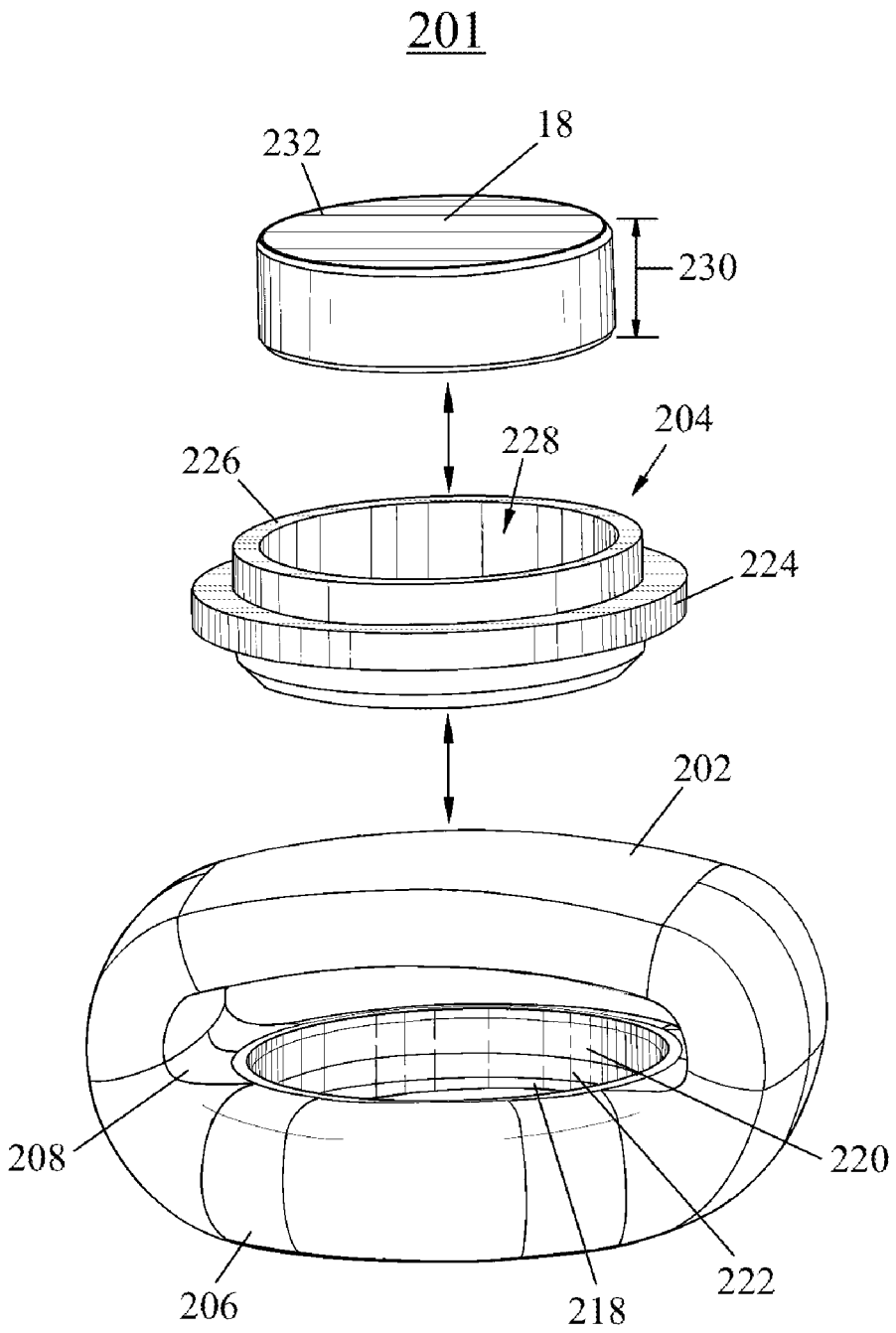
FIG. 21 is an exploded perspective view of an embodiment of a temple attachment member of the kit according to FIG. 20.

FIG. 21 is an exploded side view of the temple attachment member 201 according to the kit 200 of the present invention. The thickened body 206 has a centrally defined recessed portion 218 for receiving and securing the cup 204 in the temple attachment member 201. The recessed portion 218 is defined on an inside surface of the flexible ring 202. The wall 220 of the recessed portion 218 includes a notch 222 defined about the diameter of the wall 220. The notch 222 is configured to receive a ridge 224 formed about the outer diameter of the cup 204. The ridge 224 protrudes outwards from an outer wall 226 of the cup 204 substantially the same distance as the depth of the notch 222 defined in the wall 220 of the recessed portion 218. In this manner, the cup 204 is retained in the recessed portion 218 by the mechanical interaction between the ridge 224 in the notch 222.

In some embodiments, the ridge 224 can be made from a flexible material so that the cup 204 is removable from the recessed portion 218. In such embodiments, the ridge 224 acts as an O-ring to retain the cup 204 through an interference fit in the recessed portion 218. In alternate embodiments, the cup 204 can be formed as an integral part of the thickened body 206 during an injection molding process where the thickened body is molded over the cup. The notch 222 and the recessed portion 218 are formed as a result of the thickened body 206 being molded over the cup 204. In such a molding process, the top surface 208 of the thickened body 206 is molded to be substantially equal with an upper rim 226 of the cup 204. The internal depth 228 of the cup 204 is substantially equal to the thickness 230 of the magnetic disk 18. When assembled, the top surface 232 of the magnetic disk 18 lies substantially in the same plane as the upper rim 226 of the cup 204 and the top surface 208 of the thickened body 206. The magnetic disk 18 can be adhesively secured in the cup 204 or by an interference fit between the outer diameter of the magnetic disk and the inner diameter of the cup. Preferably, a combination of interference fit and adhesive is used to provide the most secure connection possible. This reduces the risk the magnetic disk 18 falls out or otherwise disengages the cup 204. Further, by positioning the cup 204 within the perimeter of the flexible ring 202, the temple C of the glasses B, when engaged, acts as a natural barrier to hold the magnetic disk 18 within the cup 204.

Figure 22:
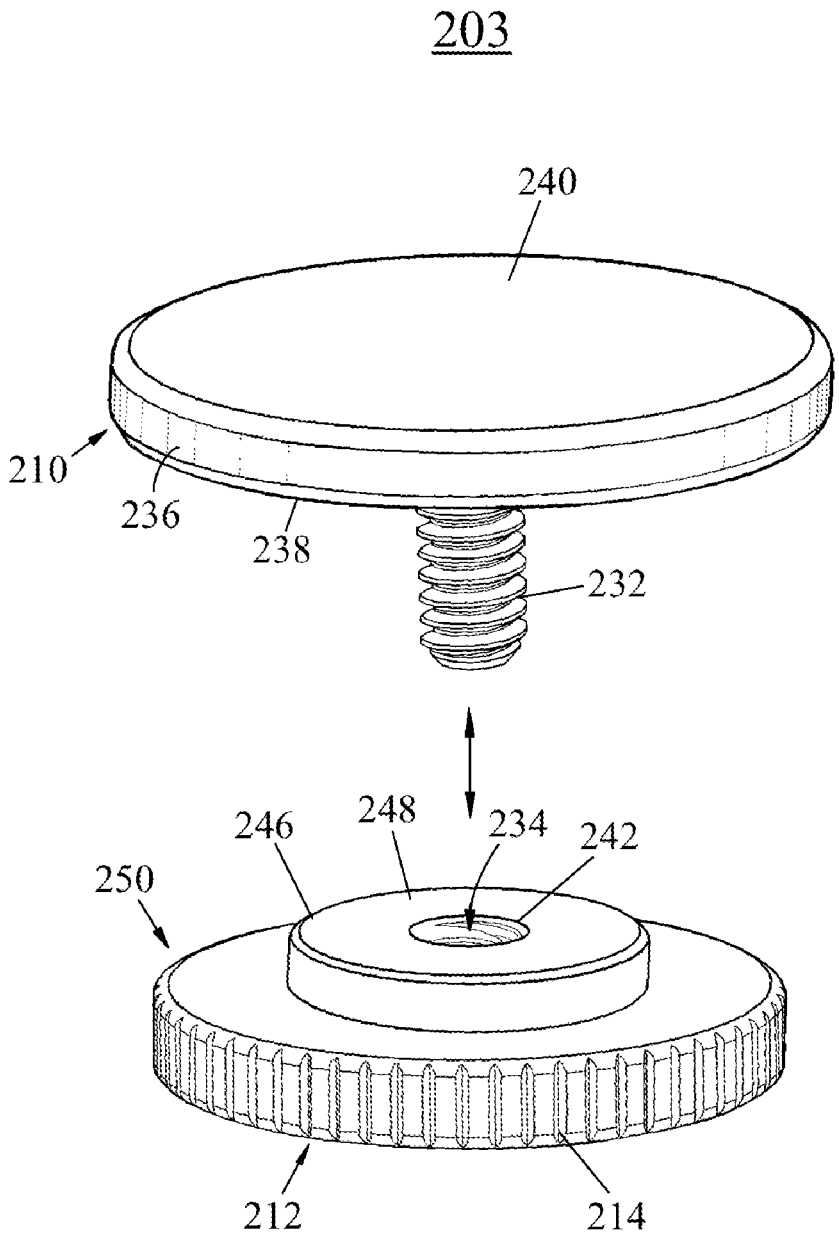
FIG. 22 is an exploded perspective view of an embodiment of a hat attachment assembly of the kit according to FIG. 20.

FIG. 22 is an exploded side perspective view of the hat attachment assembly 203 for the kit 200. The threaded pin plate 210 includes a body 236 with a threaded protrusion 232 extending from a hat-side 238. Opposite the hat-side 238 is the outer surface 240. Preferably, the outer surface 240 is smooth, with no indentations or protrusions. In some embodiments, the outer surface 240 may include a logo or other type of design/emblem printed thereon. The body 236 is preferably made of a ferromagnetic material, such as low grade steel or iron. The magnetic disk 18 is thus magnetically attracted to the ferromagnetic body 236 simply through the choice of materials. Alternatively, the body 236 may be molded from a polymer material mixed with magnetic powders. Further, in alternative embodiments, the magnetic materials may be focused only on the outer surface 240 such as by coating or embedding ferromagnetic materials over the outer surface only.

The threaded male protrusion 232 is configured for threaded engagement with a receiving aperture 234 having female threads 242 formed therein. In some embodiments not shown, the tip of the threaded male protrusion 232 may be pointed so as to more easily pierce the panel D of a hat. The receiving-side 250 of the female receiving plate 212 has a raised receiving-shoulder 246 with the receiving-aperture 234 defined therein. The receiving-aperture 234 is preferably defined through the concentric center of the female receiving plate 212. The receiving-shoulder 246 adds depth to the receiving-aperture 234 for threaded engagement with the threaded male protrusion 232.

Figure 23:
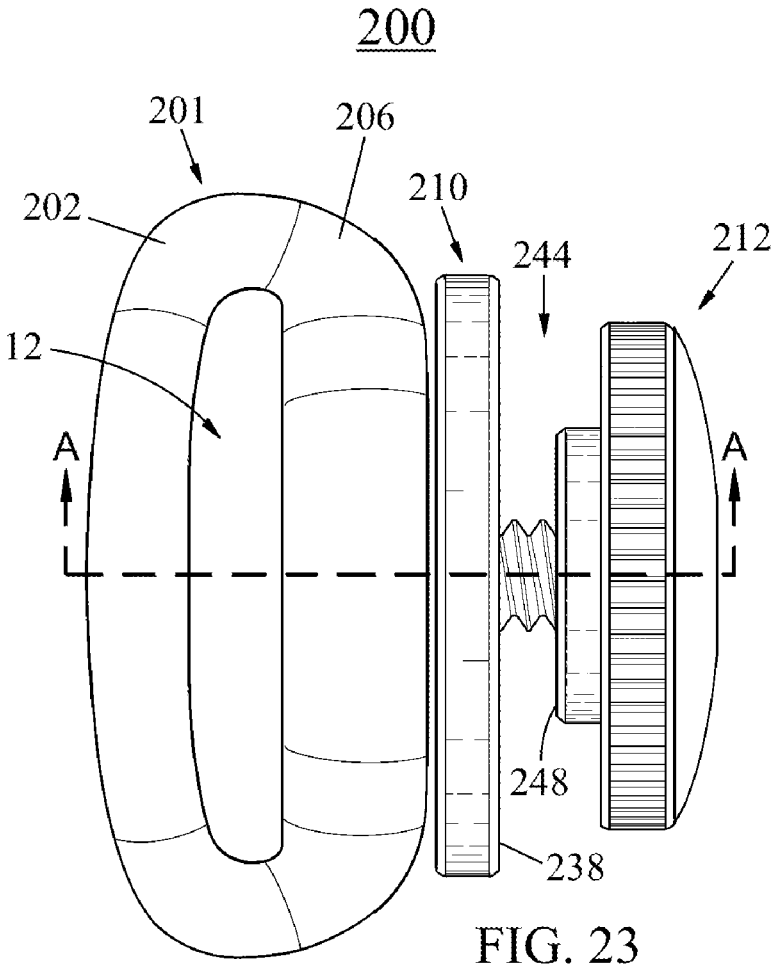
FIG. 23 is a side view of the kit of FIG. 20 marking section lines A-A.
Figure 24:
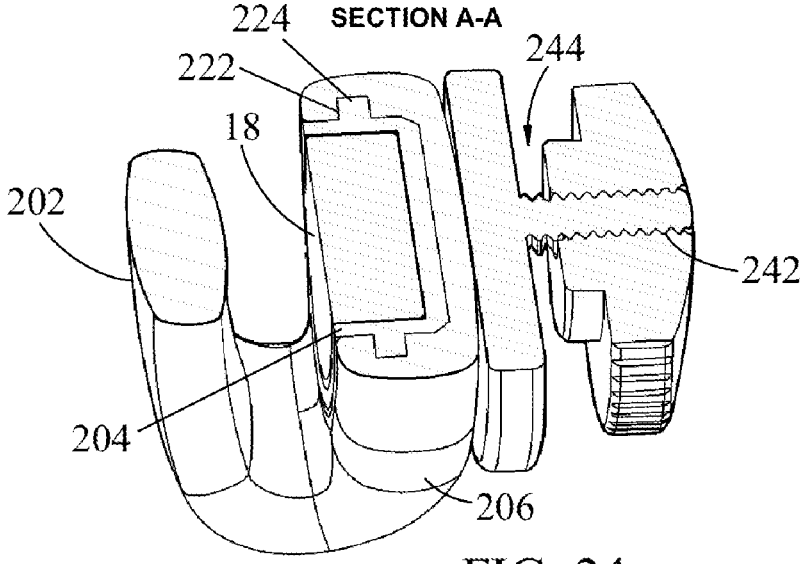
FIG. 24 is a cross-sectional perspective view of the kit of FIG. 20 taken along section lines A-A of FIG. 23.
Figure 25:
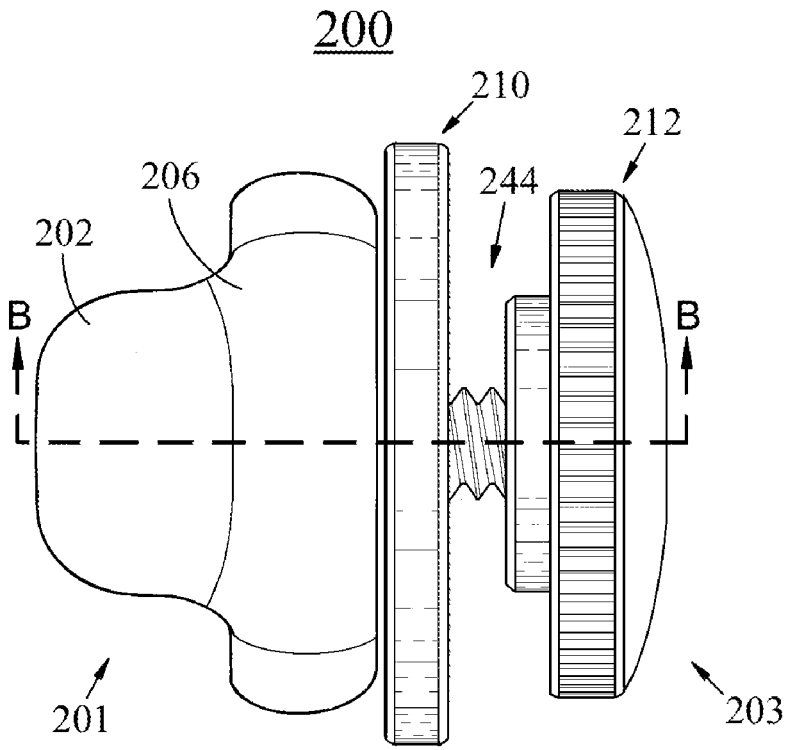
FIG. 25 is a side view of the kit of FIG. 20 marking section lines B-B.
Figure 26:
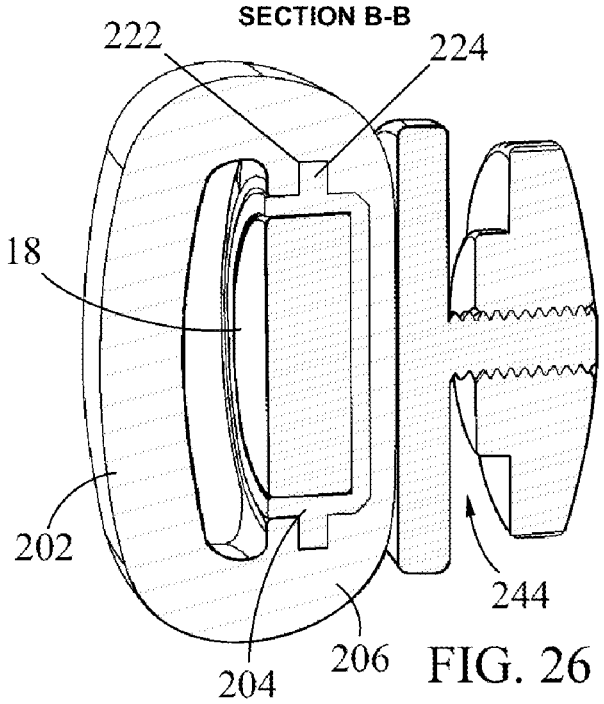
FIG. 26 is a cross-sectional perspective view of the kit of FIG. 20 taken along section lines B-B of FIG. 25.

FIG. 23 is a side view of the kit 200 marking section lines A-A. FIG. 24 is a perspective cross-sectional view taken along section lines A-A of FIG. 23. Similarly, FIG. 25 is an alternate side view of the kit 200 marking section lines B-B and FIG. 26 is a cross-sectional view of the kit 200 taken along section lines B-B. As can be seen among FIGS. 23 to 26, the length of the threaded male protrusion 232 is longer than the depth of the receiving aperture 234 such that there is a hat-gap 244 formed between the hat-side 238 of the threaded pin plate 210 and the top surface 248 of the receiving shoulder 246. The hat-gap 244 is designed so that a panel D of a hat A can be readily sandwiched between the threaded pin plate 210 and the female receiving plate 212 while achieving full threaded engagement of the female threads 242 in the receiving aperture 234. This design is also particularly useful for headwear that has a relatively thick side panel, such as some types of beanies or snowcaps and with hardhats where the panel is typically made from a hard plastic material that is thicker than a normal fabric panel in a hat, such as a baseball cap.

The hat-gap 244 also avoids creating a pinching effect that may be present when several of the alternative embodiments are used on a hat with a fabric panel. The pinching effect can be described as the appearance of the fabric of the panel being pinched or scrunched together at the point where the hat attachment assembly is connected through the panel. This can be undesirable as users may find the scrunched up fabric unsightly and wish to avoid changing the external appearance of the hat to much.

FIGS. 24 and 26 further demonstrate that the notch 222 is defined about the entire circumference of the recessed portion 218 of the thickened body 206. Similarly, the ridge 224 is defined about the entire outer diameter of the cup 204. When assembled, the ridge 224 fits tightly within the notch 222 to secure the cup 204 within the thickened body 206.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A kit to removably attach eyeglasses having a temple to headwear having a side panel, the kit comprising:

a hat attachment assembly having a magnetic pin plate and a receiving plate, and a pin extending from a backside of the magnetic pin plate, the receiving plate defining at least one aperture configured to engage the pin, wherein the hat attachment assembly is configured to attach to the side panel of the headwear; and a temple attachment member having a ring extending from a body to define an aperture configured to slidably engage the temple of the eyeglasses, wherein magnetic material is positioned in the body and is configured to magnetically secure the temple attachment member to the hat attachment assembly.

2. The kit of claim 1, further comprising:

a second hat attachment assembly identical to the hat attachment assembly and a second temple attachment member identical to the temple attachment member.

3. The kit of claim 1, wherein an outer surface of the magnetic pin plate comprises magnetic material.

4. The kit of claim 1, wherein the magnetic material comprises a magnetic disk embedded within the body.

5. The kit of claim 1, wherein a recessed portion is defined in the body.

6. The kit of claim 5, wherein a cup is secured within the recessed portion, wherein the cup is configured to receive the magnetic material.

7. The kit of claim 6, wherein an annular notch is defined about an inner surface of the recessed portion.

8. The kit of claim 7, wherein the cup further comprises a ridge defined about an outer diameter and configured to engage the annular notch within the recessed portion of the body.

9. The kit of claim 1, wherein the body defines a planar surface that is configured to prevent rotational movement of the temple attachment member around the temple.

10. The kit of claim 1, wherein the pin is configured to threadably engage the at least one aperture.

11. The kit of claim 1, wherein the receiving plate further comprises a shoulder formed about the aperture and configured to add depth to the aperture for receiving the pin.

12. The kit of claim 11, wherein, when the pin plate is engaged to the receiving plate, a gap is formed between a distal side of the shoulder and a proximal side of the pin plate.

13. The kit of claim 1, wherein the receiving plate further comprises a plurality of ridges formed around an outer perimeter.

14. A kit to removably attach eyewear having two temples to headwear having a side panel that defines an inside surface and an outside surface of the headwear, the kit comprising:

two hat attachment assemblies each configured to penetrate the side panel of the headwear, each hat attachment assembly comprising:

a pin plate having an outer surface comprising a first magnetic material and an inner surface having a threaded protrusion extending from a center point;

a receiving plate defining a threaded aperture configured to receive the threaded protrusion; and two temple attachment members each configured to slidably engage either one of the two temples and magnetically connect to either one of the two hat attachment assemblies, each temple attachment member comprising a flexible ring extending from a body having a recessed portion and a cup, wherein a magnetic disk is secured within the cup and the recessed portion is configured to receive the cup.

15. The kit of claim 14, wherein the body is configured to prevent rotation of the temple attachment member around the temple.

16. The kit of claim 14, wherein the threaded protrusion includes a pointed tip.

17. The kit of claim 14, further comprising an adhesive applied to an inner surface of the cup to secure the magnetic disk.

18. The kit of claim 14, wherein the cup defines an open face that is oriented toward the flexible ring so that, when positioned on either temple, the temple blocks the open face to secure the magnetic disk in the cup.

* * * * *